United States Patent [19]

Sohl et al.

[11] 4,037,706

[45] July 26, 1977

[54] COMPOSITE PRINT WHEEL

[75] Inventors: Gordon Sohl, Richardson; David L. Bogert, Lewisville; Richard G. Crystal, Dallas, all of Tex.; Michael C. Weisberg, San Carlos, Calif.

[73] Assignee: Xerox Corporation, Stamford, Conn.

[21] Appl. No.: 683,977

[22] Filed: May 6, 1976

Related U.S. Application Data

[63] Continuation of Ser. No. 509,193, Sept. 25, 1974, abandoned.

[51] Int. Cl.[2] ..... B41J 1/30

[52] U.S. Cl. ..... 197/54; 197/36

[58] Field of Search ..... 197/54, 53, 18, 23, 197/35, 36, 46, 42; 249/92

[56] References Cited

U.S. PATENT DOCUMENTS

| | | | |
|---|---|---|---|
| 1,946,442 | 2/1934 | Isenberg | 249/92 |
| 3,227,258 | 1/1966 | Pannier et al. | 197/54 X |
| 3,298,493 | 1/1967 | Byers | 197/36 |
| 3,651,913 | 3/1972 | Albrile | 197/36 |
| 3,677,386 | 7/1972 | Herterich et al. | 197/53 |
| 3,805,941 | 4/1974 | Cattaneo | 197/53 |
| 3,848,722 | 11/1974 | Bolan et al. | 197/53 |

*Primary Examiner*—Paul E. Shapiro

[57] ABSTRACT

A print element for an impact printer comprising a metal alloy insert member having a plurality of beams extending radially outward from a center section having an opening in the center thereof and a plurality of apertures spaced around the center opening and positioned between the center opening and the beams. Molded to the ends of the beams are character slugs having an impact surface engageable by hammer means, a print section having a print surface shaped in the form of a character and a capture section for coupling to the end of a beam whereby the energy imparted to the slug by a print hammer is substantially reflected in stresses in the print section of the slug rather than the capture section. A plastic hub is fixedly coupled to the insert member by a plurality of projections, each of which extends through a respective one of the apertures in the insert member and coacts therewith. The hub includes a flag extending radially outward a distance so as to expose a previously printed character when properly positioned relative thereto.

29 Claims, 12 Drawing Figures

COMPOSITE PRINT WHEEL

This is a continuation of application Ser. No. 509,193, filed Sept. 25, 1974, now abandoned.

CROSS REFERENCE

This case includes similar disclosure to a copending application filed concurrently herewith, titled "Damper For A Composite Print Wheel".

BACKGROUND OF THE INVENTION

This invention relates generally to impact printers and specifically to the character carrying print elements employed in serial impact printers. The invention at hand is a new and improved article of manufacture referred to as a print wheel.

Impact printers receive their name from the use of hammers or the like to impact a slug against an ink carrier and a record medium—usually 20 pound bond paper—backed by a platen. The platen is the anvil for the hammer's blow. The ink carrier is conventionally a ribbon, i.e., an elongated web impregnated with ink. The ink is transferred to the paper record medium when the two are brought into intimate contact under the blow of the hammer. Ink is released from the ribbon is raised areas on the slug corresponding to the shape of a character. Broadly, a serial impact printer is one in which a line of print is inscribed one character at a time. Classic examples of serial printers are the familiar office typewriter, teletypewriter printers and low speed computer output printers. Other classic impact printers include calculating machines such as adding machines and business accounting machines which use mostly numerical characters.

Printing elements for serial printers shaped generally in the form of a wheel or the like have been known for some time. By way of example, see U.S. Pat. Nos. 2,236,663 (1941), 3,461,235, 3,498,439, and 3,651,916. Recently, the Diablo Corporation, a subsidiary of the present assignee, has marketed a serial printer under the trade name Hytype Printer I which has a printer wheel having a plurality of slugs located at the ends of spokes or beams extending radially outward from a hub. The print wheel is rotated by a servo mechanism to position selected characters opposite a hammer and ribbon at a printing station. A printer of this type is disclosed in a U.S. patent application filed Sept. 4, 1973, in the name of Andrew Gabor, Ser. No. 394,072, titled "High Speed Printer with Intermittent Printer Wheel with Carriage Movement" being a continuation of an application filed Feb. 25, 1972, Ser. No. 229,314, the disclosures of which are incorporated by reference into this specification. The Hytype Printer I has enjoyed commercial success as an electronic printer capable of high speed and versatile operation. The print wheel it employs is basically a single element structure in that the beams and slugs are an integrally molded thermoplastic structure. This print wheel delivers superior performance with very favorable economics, i.e., the integral wheel is relatively inexpensive to manufacture. Nonetheless, when subjective standards of print quality are encountered in certain applications, the integral-structure print wheel does not always give the desired print quality.

Specifically, in automatic text editing typewriter applications the demands on a print wheel are great. In the text editing or office typing environment, the demands for high print quality cause the print wheel to be subjected to about 10 times greater force due to about five times greater hammer energy compared to a Hytype printer operating as a computer output terminal, for example. Text editing machines include a printer, a keyboard and an electronic controller having some form of memory or storage. A typist enters character information into the memory and/or creates a copy on the typewriter printer at from 0.5 to 2.0 characters per second (cps). The type information is manipulated by the electronics to correct errors and arrange format, and an edited document is automatically type by the printer under control of the electronics at speeds upward of 15 cps. Clearly, in this environment, the print wheel is asked to perform in manual and automatic modes which are distinct if for no other reason than on basis of speed. Of course, the user generally expects like print quality whether the machine is operated at a 2 or 20 CPS rate.

A plastic integral print wheel performs satisfactorily in both the low and high speed and energy modes mentioned above but not with the same print or image quality over the same life span. Loss in image quality is generally judged as the first fall off in image resolution detectible by the unaided eye. The composite print wheel of this invention, on the other hand, performs excellently over even a broader range of operating conditions than those mentioned above.

Accordingly, it is a primary object of the instant invention to develop a print wheel suitable for a wide range of impact printing environments.

Another object of this invention is to obtain high print quality in document creation equipment employing a print wheel impact printer along the presently described vane.

Yet, another object of the current invention is to increase the life span of print wheels of the present type.

Another object of the invention at issue is the construction of a print wheel having significantly improved mechanical and functional features over prior print wheel designs.

Yet, another object of this invention is to depart from the design construction of prior art print wheels by building a composite print wheel made up of at least two components including the spoke or beam structure having character slugs attached to the end of the beams.

Still, another object of the present invention is to design a print wheel having character slugs whose print surfaces are capable of withstanding repeated high energy blows from a hammer yet being attached to beams which have excellent deflection properties to permit the slug to be deflected to and from a record medium by a hammer for printing.

Yet, a further object is to devise a slug structure for a print wheel that includes two separate sections. One section is for carrying the impact surface engageable by a hammer and the other section for coupling to a spoke. The use of separate sections imparts added life to a slug because the impact portion or section withstands most of the stresses created by the hammer's blow. This protects the bond holding the slug to the end of the beam from the hammer action.

BRIEF DESCRIPTION

The above and other objects of the instant invention are realized with a unique print wheel. The wheel includes type or character slugs molded of a bulk filled polymer over the tips of the spokes or beams of the wheel. The spokes and its circular base form an insert member fabricated from a thin sheet of metal. Each beam is like a leaf spring which vibrates or oscillates when deflected from a common plane in which all the beams lie. This feature gives the spokes exceptionally good deflection properties since the beam is not only easily deflected toward a print station but quickly retreats back toward the common plane. Also, the deflection properties are enhanced by the weighting of the beam tips with the slugs. The deflection property of the beams or spokes is controlled or tailored by coupling a damper to the beams. The preferred damper is a fabric material adhesively bonded to the beams.

The remaining components of the print wheel include a hub connected to the base of the insert member and a cap for handling the article. The hub includes a key or notch for aligning the wheel to a fixed angular position so that specific slugs can be addressed by rotating the wheel through a prescribed angular displacement. The hub also includes a flag extending radially outward amidst the beams. The flag underlines a character when it is rotated to alignment with the printing station and otherwise locates the current print position for the operator.

DESCRIPTION OF THE DRAWINGS

Other objects and features of the present invention will be apparent from the previous and a further reading together with the drawings which are explained in the following sentences.

DETAILED DESCRIPTION

Figure 1:
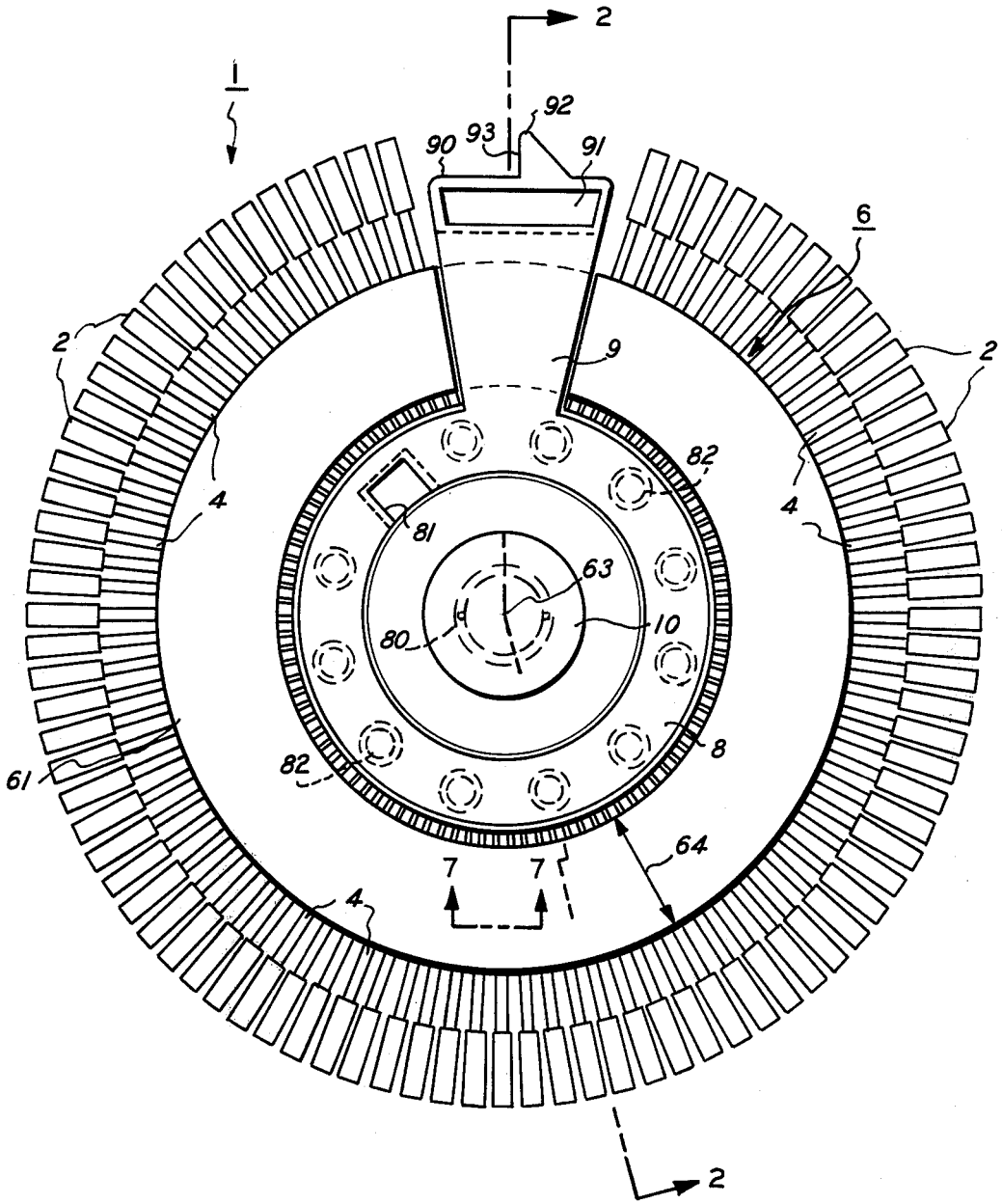
FIG. 1 is a plan view of a composite print wheel according to the invention herein.

The presently preferred embodiment of the invention is the print element or wheel 1 of FIG. 1. The print wheel is a composite structure being made up of several components, the most prominent of which in FIG. 1 are the character slugs 2 molded onto the ends of the spokes or beams 4. Other components include the damper 6 mounted over the beams to alter their deflection properties and the hub 8 riveted to the center of the wheel with its flag 9 extending outwardly amidst the beams. A cap 10 for handling the wheel resides at the core of the wheel atop the hub.

Referring to FIGS. 3–6, the details of a character slug are illustrated in more detail. The character D (capital d) is selected as typifying the structure of other character slug structures. For the present wheel, there are 88 characters defining a font suitable for most English language document creation requirements. A 92 spoke wheel is used for other language applications. The font includes upper and lower case characters, numbers, punctuation marks and other useful symbols. The number of characters in a font is often influenced by the binary or other digitalized coding representation used by the electronics associated with the impact printer using the wheel. For document creation purposes, a five binary bit code is required to at least include the English alphabet in the font since it yields 32 bit combinations. More practically speaking, a six bit code with its 64 bit combinations is more useful since both upper and lower case and punctuation marks can be encompassed within a 64 character font. The present 88 character wheel requires a seven bit code but obviously the capacity of the font is not strained by reason of a shortage of available binary bit combinations to represent the characters in the font. The unused bit representations are assignable to "space," carriage return and other functional commands. The Hytype printer mentioned earlier presently employs a print wheel having 96 character slugs dispersed about the wheel.

The slugs are molded onto the tips of the beams using a bulk 21 filled polymer 22 material and thereafter are plated by suitable processes with a metallic wear resistant coating 23. The mold, of course, shapes the entire slug including the printing surface 24 (in this case the letter D) and the impact surface 25. The printing surface is the raised portion comprising the shape of the letter D which in a typewriter like printer causes the ink from a ribbon to be transferred to paper in a corresponding letter D shape under the blow of a hammer delivered to the slug on the impact surface 25.

The impact surface is that beyond the tip of the beam. This definition divides the slug into two principal portions being the printing section 26 lying mostly under the letter D or other character and the capture section 27 surrounding the tip of a beam 4. With this division or separation of the printing section from the capture section, the joint between the slug and beam is protected from the stresses set up in the slug under the forces transmitted to the slug during a printing process. The primary force acting on the slug is that due to compression between a hammer and platen.

Every character slug has a bench mark 28 for locating the character on the slug relative to a printing line. The bench mark is precisely located relative to the center of the wheel and the character is precisely located relative to the bench mark. The bench mark is located on the slug at a position on a shorter or equal radius to that for the lowest positioned character in the font—normally the "underline" character.

The capture portion 27 of the slug includes a rebound surface 29 which lies below the impact surface 25 so as to abut against a backstop or bumper which includes a rigidly mounted member for limiting mechanically the distance the beam and slug are able to deflect on rebound. The thickness of the slug is selected not merely to impart strength and durability but also to yield an offset 29A from the beam 8. The offset enables the bumper or backstop mechanism to be physically closer to the wheel.

The capture section 27 of the slug also includes the beveled region defined by the sloped surface 27A and the plane surface 27B. The beveled region shortens the dimension of surface 24A underlying the printing surface 24 so as to minimize the possibility of interference with the ribbon or other apparatus between it and a platen. Also in the molding process, the flashing operation is enhanced by reason of this shape among other benefits.

Another significant feature of the composite slug and beam structure of this invention is that there are substantially no voids or severe discontinuities within the body of a slug 2. Typically, in molding processes, a pin or other restraining device is used to hold a desired relation between an insert member such as a beam 4 and the mold. The restraining pin results in the formation of a void or discontinuity within the body of the slug which is detrimental to the slug's life. These discontinuities are avoided in the instant invention. The tip of a beam is cantilevered inside a mold with the liquid plastic allowed to freely flow about it. Keeping the beam tip within the capture section means that it is not subjected to untolerable bending forces when the liquid form of the plastic is introduced into the mold or during the curing of the plastic to a solid state. If the beam tip extends into the middle of the impact section, for example, there is a high probability that the beam tip will be bent during the process of forming the slug. The bending of the beam tip in this fashion may cause the beam to lie outside the common plane of the wheel or otherwise wrongly orient the character surface on the slug.

Figure 4:
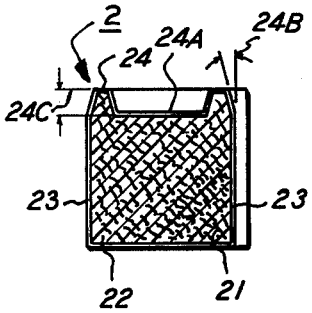
FIG. 4 is an elevation sectional view of a character slug taken along lines 4—4 in FIG. 5.

Angle 24B in FIG. 4 illustrates the slope from vertical of the side surfaces on the characters and the height 24C of the printing surface 24 above the underlying surface 24A. The angle 24B is about 15° for the characters and the height is about 0.015 inches in the preferred wheel. This slope along with the height 24C determines the minimum width of a slug. The angle and height are selected to permit clearance between adjacent slugs and to yield a desired image quality in the marking or printing operation.

Figure 9:
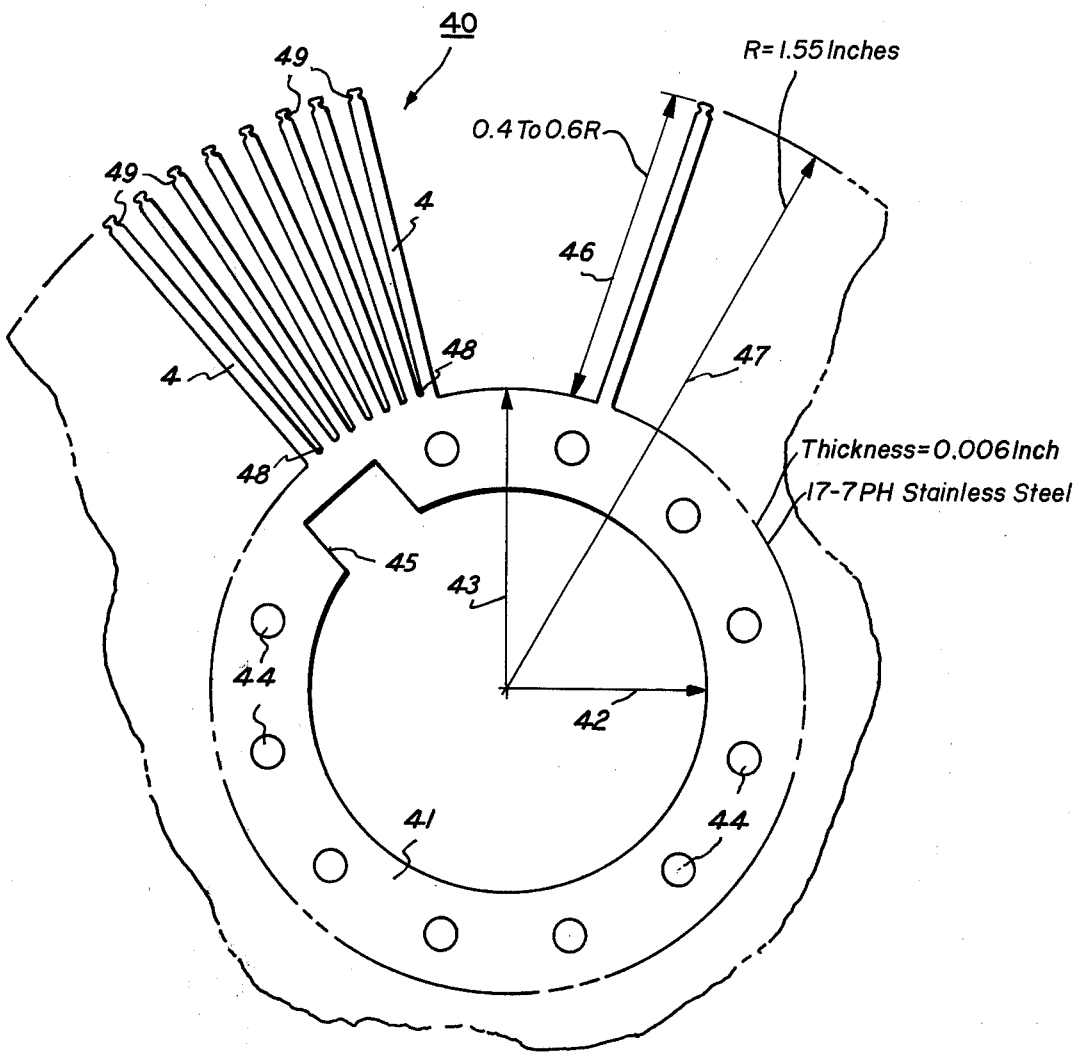
FIG. 9 is a partial plan view of the insert member used in the composite print wheel of FIG. 1.

Turning now to the beams 4, reference will be made to FIGS. 3, 5, 6 and 9. FIG. 9 shows the detail of the beams. The beams are fabricated from a single piece of 0.006 inch nominal sheet metal yielding an insert member 40, which has a circular center section, or base 41, from which the beams 4 extend radially outward. The center of the base 41 is cut out to reduce the weight and inertia of the total wheel. The thickness of the base as defined by radii 42 and 43 is selected to provide structural integrity sufficient to maintain the cantilevered beams within a common plane and to enable the hub 8 to be coupled to it by means including the rivet or staking holes 44. The notch 45 is provided to permit an alignment key on a printer to engage the print wheel.

A significant feature of the beams is their constant width and cross-sectional area along their length. Often, spoke members have different widths at different radii. Here, it is desirable to keep the mass of the wheel to a minimum so the inertia of the wheel is minimized; but, also, this geometry enhances the process of molding the slugs onto the beams. Consequently, the width and thickness of the beam at its joint with the base is maintained out to near the tip. The width at the joint is selected by factors including packing density of spokes at the radius 43 where the beams begin. The packing density is influenced by the overall dimension of the wheel and the beam length 46. The overall dimension is a function influenced by a given printer design. Beam length is a function of several factors including the oscillation of deflection properties of a slug loaded beam. In the presently preferred embodiment, the beam length is about 0.695 inches for a print wheel with an overall radius of 1.550 inches. Roughly, (plus or minus 0.10 inches) the radius 47 is twice that of radius 43 and is found to create a beam with excellent deflection properties.

The crotch 48 between beams is rounded to a nominal radius of 0.005 inches on each beam. This rounding in the crotch region greatly improves the stress conditions at the joint between a beam and the base. This rounding is a limitation on the packing density mentioned above.

At the tips or outer ends of the beams, a neck 49 is formed so as to create an anchor buried within the slug. The neck shape increases the radially directed force required to pull a slug off the end of a beam. The neck shape is preferred because a circular hole in the middle of the beam. Altering the width of cross-section of the beam in the capture area is the important matter so that the anchor is created.

Figure 7:
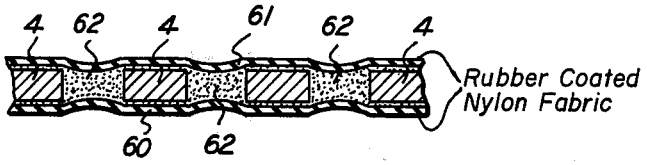
FIG. 7 is a sectional view taken along lines 7—7 in FIG. 1 illustrating the connection of the damper to the beams.
Figure 6:
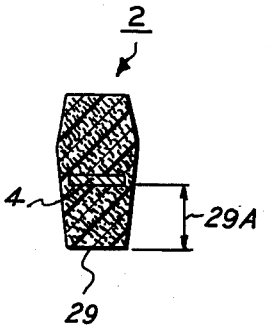
FIG. 6 is an elevation view in section of a slug and beam taken along lines 6—6 in FIG. 5.

The damper 6 is shown in FIGS. 1 and 7. The damper comprises two circular rings with ring 60 seen in FIG. 1 located on the impact side of the wheel and ring 61 located on the printing side of the wheel. The rings are made from a fabric in the ring or circular shape and have an adhesive 62 applied to them. The rings are aligned concentric with the axis 63 of rotation of the wheel which is normal to the plane of the drawing shown in FIG. 1. The adhesive bonds the rings to the beams 4 and to each other in the regions between the beams. The width 64 of the rings is selected so that they are coupled only to the beams and not the hub 8 or the slugs 2.

Ring 61 has a section cut away in the region of the flag 9 whereas ring 60 is a full circular surface. Functionally, the rings alter the deflection properties of the beams by reducing the vibration amplitude and duration of the beams for a given deflection of a beam tip from the common plane shared by the beams. The rings lie across adjacent beams and the deflection of one is passed to its adjacent neighbors to some degree. The width 64 is selected to minimize this deflection coupling between adjacent beams yet yield a desired damping with the outside diameter being important. Impregnating the fabric with an elastomer enhances the function of the rings. The location and material chosen for the rings is also important for minimizing the inertia of the wheel which is relevant to obtaining high speed rotational positioning of the wheel during a printing operation. A ring on both sides gives better damping results although one may be used. The two rings are also preferred because of ease of construction since one ring covers the adhesive placed on the other for attachment to the beams.

The damper 6 controls the maximum rebound amplitude of mechanically limiting it. It adds comparatively little to the total inertia of the wheel (less than 10%) and because of its structure is easily attached to the print wheel by an adhesive. The damper rings 60 and 61 dampen oscillations by setting up adjacent spoke vibrations out of phase with the impacted (by a print hammer) spoke and by linking struck and adjacent spokes to cause interference. An outside diameter of 2.1 inches for rings 60 and 61 was found to be optimum for dampening the struck spoke without excessively exciting the adjacent spokes and for viscous losses in the damper material.

Figure 10:
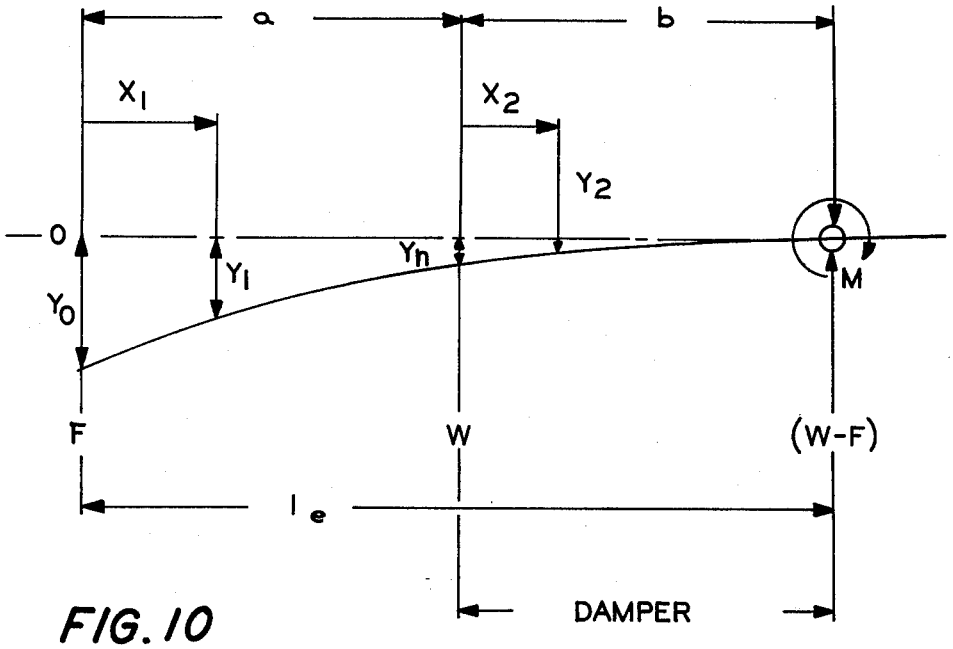
FIGS. 10 and 11 are load diagrams of a beam illustrating the forces acting on a deflecting beam and giving the definitions of the mathematical terms descriptive of the deflection process.

A simplified free body diagram of a beam and damper is shown in FIG. 10. The parameters in FIG. 10 descriptive of a typical beam 4 are:

$l_3$ = Flexible length of beam
$y_o$ = Maximum displacement
F = Tip force needed to obtain displacement $y_o$
W = Simplified force as a result of damping rings
$y_n$ = Displacement at point of damping The beam 3 in FIG. 10 is divided into sections *a* and *b* where *b* is the region of the beam where the damper is connected. The discontinuity in the beam due to the damper gives call for two equations for shear load:

For Beam Segment a $$EI\frac{d^3y}{dx^3} = -F \qquad \text{(a)}$$

For Beam Segment b $$EI\frac{d^3y}{dx^3} = W - F \qquad \text{(b)}$$

where $E$ = Modulus of elasticity, psi
$I$ = Moment of inertia, in $^4$
$W$ = Damping load of the rings, lbs.
$F$ = Shear load, lbs.

By integrating and solving for end conditions, a cure for each segment can be defined. Rearranging the equations yields the general equation:

$$F = \frac{-EIy_o + W(\frac{ab^2}{2} + \frac{b^3}{3})}{\frac{a^3}{3} + ba^2 + ab^2 + \frac{b^3}{3}} \qquad \text{(c)}$$

This general equation (*c*) may be used to find the maximum bending moment and thereby the maximum stress as a function of damper load (W). For a preferred embodiment, $a = b = \frac{1}{2}\, l_e$ and equation (*c*) reduces to:

$$F = \frac{-3EIy_o}{l_e^3} + \frac{5}{16}W$$

and $$F = F_o + \frac{5}{16}W$$

where $$F_o = \frac{-3EIy_o}{l_e^3}.$$

When W = O, F = $F_o$ and $F_o l_e$ represents the maximum bending moment of an undamped spoke. For conditions where W < 1.60 F, the damper would reduce the maximum stress in the spoke or beam and, therefore, increase the fatigue life of the beams. Tests have shown that the fatigue life can be improved by a factor of 20 by using the damper rings 60 and 61. Generally, maximum fatigue life is approached when the damper load W to deflection load F is $W/F = 1$. The 20 times improvement mentioned above was obtained by a reduction of the maximum stress.

Figure 11:
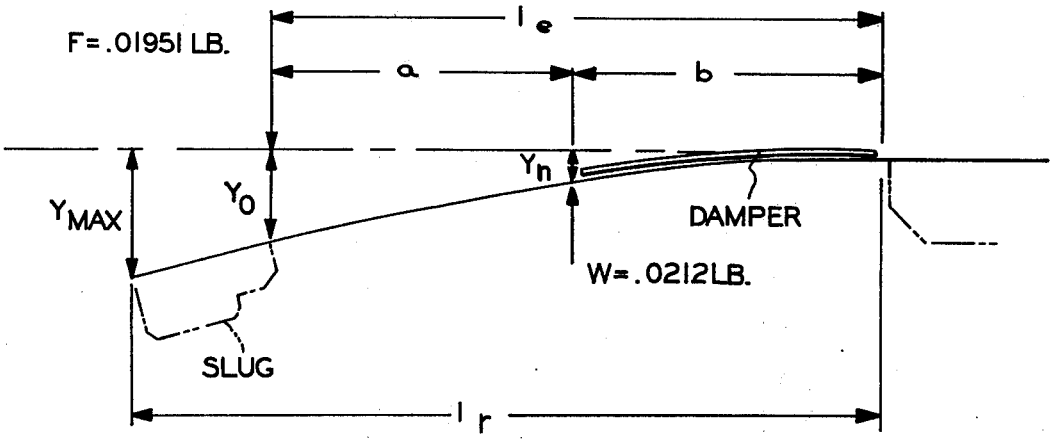

The preferred structure has a force diagram as shown in FIG. 11 wherein:

$l_e$ = 0.65 inches
$y_o$ = 0.071 inches as calculated for X = $l_r - l_e$ = 0.15 inches where $l_r$ = 0.80 inches and $Y_{max}$ = 0.095 inches
$y_n$ = 0.018 inches
$a = b$ = 0.325

For these numbers $W/F$ = 1.29 for $y_n$ = 0.018; 1.08 for $y_n$ = 0.019; 0.83 for $y_n$ = 0.02.

In practice, the load is distributed over the width of the damper rings and thereby yields even greater fatigue life than would be calculated in the above manner.

The angle at which the character slug printing surface is sloped relative to vertical affects the distance the beam is to be deflected to impact the printing surface against a ribbon, paper and platen. This angle affects the damper properties.

Figure 12:
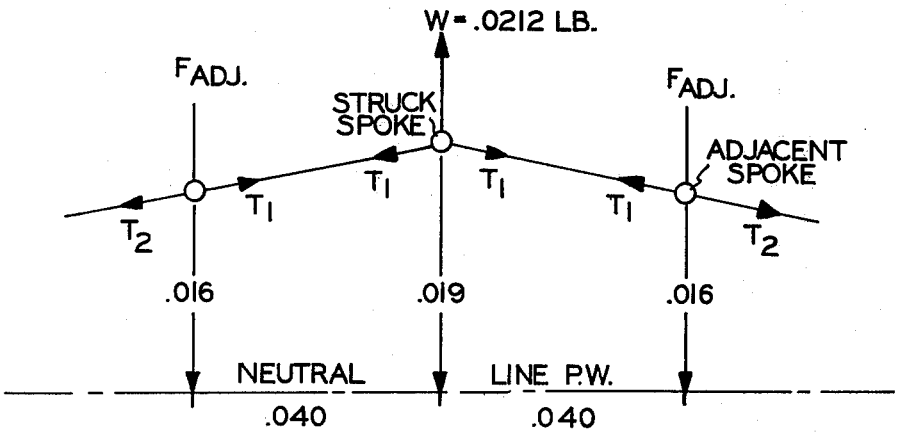
FIG. 12 is a load diagram of three adjacent beams giving definitions of mathematical terms descriptive of adjacent beam deflections.

FIG. 12 is a load diagram for a struck and two adjacent beams. The numbers shown are in inches if not otherwise indicated and are found from the following conditions:

The damper load W is 0.0212 lbs. The displacement of the struck beam at point of damper load ($y_n$) is 0.020 inches. Displacement of the adjacent spokes at the points of damper load is 0.016 inches as calculated for a centrally loaded spoke with a tip deflection of 0.04 inches. $T_1$ = 0.238 lbs., where $T_1$ is the tension force in the fabric damper.

The following calculations are for the equations disclosed herein depicting an analysis per FIG. 10.

Assuming that all the tension is within the outer sections on rings 60 and 61 about 0.050 inches wide, the damper material has a minimum tear strength of 5.65 lbs./inch.

Segment a

1. Shear $$EI\frac{d^3y}{dx^3} = -F$$

2. Moment $$EI\frac{d^2y}{dx^2} = -Fx + \cancel{C_1}^{\,O}$$

$$\text{at } x = O,\ \frac{d^2y}{dx^2} = O$$

3. Slope $$EI\frac{dy}{dx} = -\frac{Fx^2}{2} + C_2$$

$$\text{at } x = a,\ \frac{dy_1}{dx_1} = \frac{dy_2}{dx_2}\Big]_{x_2} = O$$

$$\rightarrow C_2 = \frac{Fa^2}{2} = Z_2$$

4. Deflection $$EIy = -\frac{Fx^3}{6} + C_2x + C_3$$

$$\text{at } x_1 = a,\ y_1 = y_2\ \Big]_{x_2} = O$$

$$\rightarrow C_3 = \frac{Fa^3}{6} - C_2a + Z_3$$

$$= \frac{Fa^3}{3} - Fab^2 - Fba^2 - \frac{Fb^3}{3} + \frac{Wb^2a}{2} + \frac{Wb^3}{3}$$

Segment b

1.

$$EI\frac{d^3y}{dx^3} = W - F$$

2.

$$EI\frac{d^2y}{dx^2} = Wx - F(a + x) + \cancel{Z_1}^{\,O}$$

-continued $$\text{at } x = O, \frac{d^2y}{dx^2} = -Fa$$

$$EI\frac{dy}{dx} = \frac{Wx^2}{2} - Fax - \frac{Fx^2}{2} + Z_2$$

$$\text{at } x = b, \frac{dy}{dx} = O$$

$$\rightarrow Z_2 = Fab + \frac{Fb^2}{2} - \frac{Wb^2}{2}$$

$$EIy = \frac{Wx^3}{6} - \frac{Fax^2}{2} - \frac{Fx^3}{6} + Z_2x + Z_3$$

$$\text{at } x = b, y = O$$

$$\rightarrow Z_3 = \frac{Fab^2}{2} + \frac{Fb^3}{6} - \frac{Wb^3}{6} - Z_2b$$

$$= -\frac{Fab^2}{2} - \frac{1}{3}Fb^3 + \frac{1}{3}Wb^3$$

Max $y_1 = y_o$ at $x_1 = O$ $$\text{then } EIy_o = C_3 = -F\left(\frac{a^3}{3} + ba^2 + ab^2 + \frac{b^3}{3}\right) + W\left(\frac{ab^2}{2} + \frac{b^3}{3}\right)$$

$$\text{and } F = \frac{-EIy_o + W\left(\frac{ab^2}{2} + \frac{b^3}{3}\right)}{\left[\frac{a^3}{3} + ba^2 + ab^2 + \frac{b^3}{3}\right]}$$

Given $y_n$, $y_o$ and $a = b = 1/2l$

From Segment b $$EIy_n\Big]_{x_2 = O} = Z_3 = -\frac{Fab^2}{2} - \frac{Fb^3}{3} + \frac{Wb^3}{3} = -\frac{Fl^3}{16} - \frac{Fl^3}{24} + \frac{Wl^3}{24}$$

$$= -\frac{5}{48}Fl^3 + \frac{Wl^3}{24} = EIy_n$$

And $$F = \frac{-EIy_o + W\left(\frac{ab^2}{2} + \frac{b^3}{3}\right)}{\left[\frac{a^3}{3} + ba^2 + ab^2 + \frac{b^3}{3}\right]} = \frac{-EIy_o + W\left(\frac{5l^3}{48}\right)}{l^{3/3}} = \frac{-3EIy_o}{l^3} + \frac{5}{16}W$$

Then $$EIy_n = -\frac{5}{48}\left[\frac{-3EIy_o}{l^3} + \frac{5}{10}W\right]l^3 + \frac{Wl^3}{24}$$

$$= \frac{5}{16}\frac{EIy_o}{l^3} - \frac{25}{768}Wl^3 + \frac{32}{768}Wl^3 = \frac{5}{10}\frac{EIy_o}{l_3} + \frac{7}{768}Wl$$

$$\rightarrow W = EI\left(y_n - \frac{5}{16}y_o\right)\frac{768}{7l^3}$$

For The Print Wheel In The Following Example

Stainless steel PH 17-7 0.006 inches thick, 0.032 inches beam width

| $E = 29 \times 10^6$ psi | $Y_n$ in | W lb | F lb | W/F |
|---|---|---|---|---|
| $I = 0.576 \times 10^{-9}$ in.$^4$ | 0.018 | 0.0279 | 0.0216 | 1.29 |
| $l = 0.65$ in. | 0.019 | 0.0212 | 0.0195 | 1.08 |
| $Y_o = 0.095$ in. | 0.020 | 0.0145 | 0.0174 | 0.83 |

Figure 2:
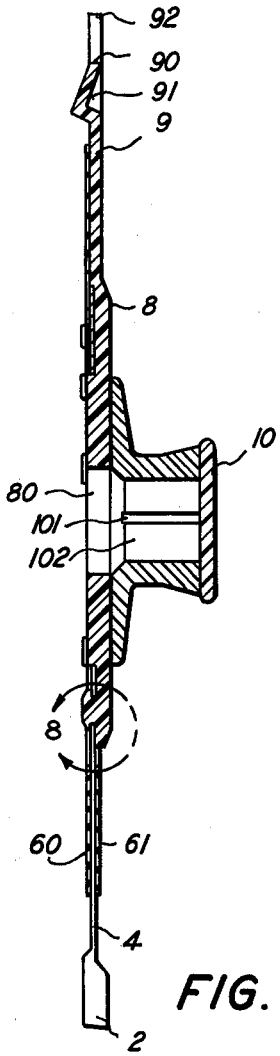
FIG. 2 is a sectional elevation view of the composite print wheel in FIG. 1 taken through lines 2—2.
Figure 8:
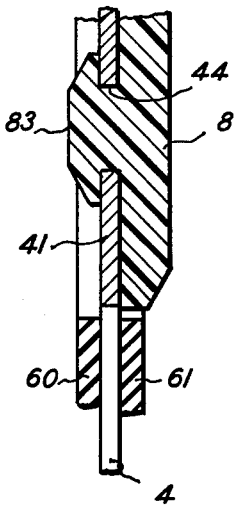
FIG. 8 is an enlarged view of the region of FIG. 2 surrounded by the circular arrow 8.
Figure 3:
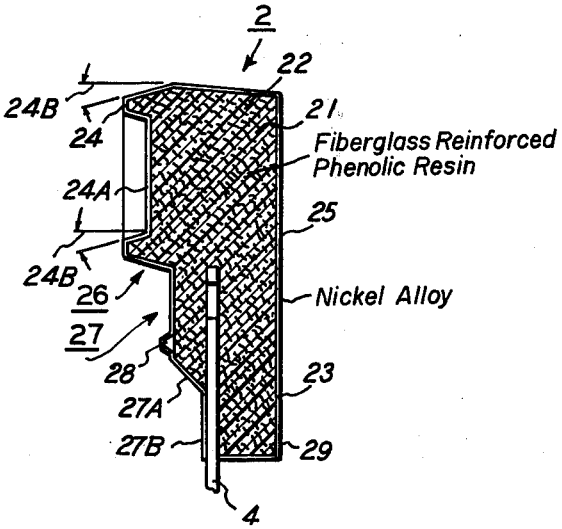
FIG. 3 is an enlarged side sectional view illustrating a typical character slug and beam tip structure.
Figure 5:
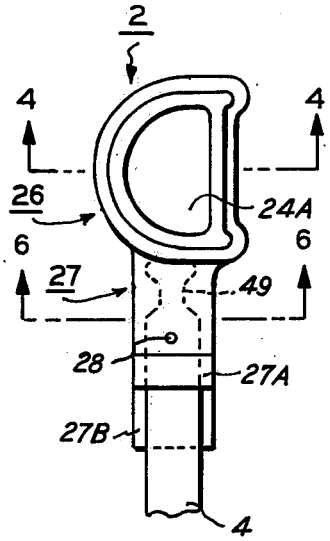
FIG. 5 is a plan view of a character slug with the tip of the beam embedded inside the slug shown in dashed lines.

The hub 8 is shown in FIGS. 1, 2 and 8. It is a circular shaped piece with a hole 80 in the center to permit attachment of the wheel to a shaft on a printer for rotating the print wheel in a printing operation. The alignment of the wheel to that shaft is provided by the keyway or notch-81. Square notch 81 is precisely fabricated to establish within desired tolerances the angular position of the character slugs 2 and flag 9 to the shaft. The hub is a thermoplastic material formed with eleven rivets protruding perpendicular to its body in the molding process. The rivets fit through the eleven holes 44 in the insert member 40. Ultrasonic staking the rivets creates the beads 83 which lock the hub securely to the insert member. The detail of the rivet bead, insert member and damper rings is shown in the enlarged view of FIG. 8.

The flag 9 is integral with the hub 8 being fabricated with the hub in a molding process. FIGS. 1 and 2 show the flag. The flag is a truncated pie shape piece whose width increases with radii--unlike the beams which have a fixed width over their length. The outer end of the flag includes a straight edge 90 which underlines the line of characters being printed. The sloped surface 91 facing an operator, i.e., the surface on the impact side of the wheel angled from the plane of the wheel, visually emphasizes the straight edge and minimizes the reflection of light to a user's eyes. Also, surface 91 is a convenient location for a label to identify the wheel as an operator aid. The angle or slope of surface 91 is about 20° to the plane of the wheel with the elevation above that plane increasing at shorter radii. The mass of the flag is not increased to obtain surface 91 but rather the flag is caused to buldge outwardly as best seen and understood from an inspection of FIG. 2. Once again, it is important to minimize mass in order to minimize the wheel's rotational inertia. In some printer environments, the sloped surface 91 should be eliminated to minimize mechanical interference with other printer components.

At the very end of the flag is the pointer 92. The pointer is a vertical reference mark to help the user to visually align the eye to the printing position. The vertical surface 93 and straight edge 90 form a "cross-hair" for locating characters in a line of print. The single pointer appears to the left of the last character with the user left to mentally bracket the character. A single pointer is preferred especially for proportional space fonts because the characters will not appear centered in all cases between two brackets. The deviation from a center position is less noticeable to the eye when one pointer is used.

The cap 10 is the handle for article 1 as well as a means to help attach the wheel to a shaft in a printer or other device. The cap is shown in FIGS. 1 and 2. It is bonded to the hub by an adhesive on the printing side of the print wheel. The insertion and withdrawal of the wheel from a shaft is envisioned as a manual task with the part being handled during those operations by means of the cap. A slot or key 101 is cut into the inside surface of the cylindrical cavity 102 within the cap. This slot allows air to escape during installation to a shaft.

The slugs are plated with a metallic coating 23 to enhance the resistance to abrasive wear of the printing surface 24. The plating has proved highly successful to this end. Abrasion typically wears away the edges of the raised print surface on the printing side of the character slug. This wear results in a fuzzy look in the printing product. Plating a metal onto a plastic substrate, such as a phenolic material as used for the slugs, is not obvious because the chance of obtaining a strong adhesive bond is not expected. In fact, the peel strength between the metal and plastic has been measured to be as low as less than 0.25 pounds per inch. Despite this very low peel strength, life tests on the wheel herein described have been exceedingly high to the point to support the conclusion that the peel strength of the plating is immaterial to print wheel life. The plating or coating 23 although not originally predicted to be possible over a plastic substrate, nonetheless, yields a print wheel of greatly enhanced life expectancy and enhanced print quality.

EXAMPLE

The following is a specific example of a very successful composite print wheel according to the present invention. Its success is especially evident in document creation, text editing applications. Print wheels as described in this example have exhibited a life beyond 16 $\times 10^6$ impacts at $1 \times 10^5$ psi. End of life or failure is defined as the first visual detection of a print quality defect which is directly attributable to a print wheel failure rather than a ribbon, carriage or other failure. Common wheel failures include slug breakage, printing surface collapse and beam breakage.

The inertia of the print wheel about the axis through its center of rotation should be from about $6.4 \times 10^{-4}$ in-oz-sec$^2$ and to about $8.0 \times 10^{-4}$ in-oz-sec$^2$ allocated to the components about as follows:

| | |
|---|---|
| Insert member 40 | $1.6 \times 10^{-4}$ in-oz-sec$^2$ |
| Hub 8, flag 9 and cap 10 | $1.2 \times 10^{-4}$ in-oz-sec$^2$ |
| Character slugs 2 | $4.0 \times 10^{-4}$ in-oz-sec$^2$ |
| Damper 6 | $0.2 \times 10^{-4}$ in-oz-sec$^2$ |
| Plating 11 | $1.0 \times 10^{-4}$ in-oz-sec$^2$ |

The slug materials 21 and 22 in the preferred wheel are a fiberglass reinforced phenol-formaldehyde formulation available from Fiberite Corporation of Winona, Minnesota, identified as FM4011 melt flow 12-16 by spiral flow test. The described material has met the following property specifications:

Mechanical Properties

Good impact strength 0.45 ft-lb./inches — ASTM D256

Flexural strength 12,000 psi minimum — ASTM D790

Tensile strength 10,00 psi minimum — ASTM D638

Shore D. hardness greater than 91

Thermal Properties

Heat distortion temperature 375° F — minimum at 264 psi — ASTM D648

Physical Properties

Specific gravity 1.78–1.80, 23/23C — ASTM D792

Water absorption, weight gain — 24 hours at 23° C — 0.12% maximum — ASTM D570

The plating in the preferred wheel is a nickel alloy. The plating is done by a dipping process to an average thickness of about 0.001 inches with a mask used to cover the surfaces other than the type or character slugs. The surface of the slugs is pretreated with a chromic acid to roughen the surface enhancing the adhesion of the nickel to the phenolic.

The insert member 40 in the preferred embodiment is a cold reduced (Condition C) 17-7 PH stainless steel from ARMCO Steel Corporation, Middletown, Ohio. The member 40 is fabricated from a 0.006 inch strip of uniform quality and condition free from internal and surface defects. The annealed (Condition A) strip material is cold reduced to obtain Condition C.

The chemical composition is per ASTM Method E38:

| Element | Percent |
|---|---|
| Carbon, max | 0.09 |
| Manganese, max | 1.00 |
| Phosphorous, max | 0.04 |
| Sulphur, max | 0.03 |
| Silicon, max | 1.00 |
| Chromium | 16.00 - 18.00 |
| Nickel | 6.50 - 7.75 |
| Aluminum | 0.75 - 1.50 |

Mechanical Properties

Tensile strength 200,000 psi maximum — ASTM A310

Fatigue strength for $10^7$ cycles is 82,300 psi

Yield strength 0.2%, offset 175,000 psi minimum — ASTM A370

Elongation in 2 inches is 1% minimum - ASTM A370

Rockwell hardness C41 minimum — ASTM E18

The CH900 form of 17-7PH may also be used. This form is produced by heating the Condition C material to 900° F and air cooling to room temperature. The CH900 material is magnetic and corrosion resistant giving a tensile strength of 265,000 psi, yield strength at 0.2% offset of 260,000 psi elongation in 2%.

The damper rings 60 and 61 are fabricated in the shapes shown in the preferred embodiment from a Buna N coated nylon fabric 0.006 inches thick available from E. I. DuPont de Nemours & Co. of Wilmington, Delaware, under the number BN-5027. The adhesive 62 may be any conventional transfer adhesive commercially available having an adhesive peel strength of in the order of 0.43 lb./inch. The presently preferred adhesive is a product of the Minnesota Mining and Manufacturing Corporation of Minneapolis, Minn. identified as 467 Transfer Adhesive. If the bond is not adequate, the outer edge of the damper rings begins to separate from the spokes.

The hub and flag 8 and 9 are fabricated from a thermoplastic such as pehnol-formaldehyde resin. Similarly, the cap 10 is a suitable plastic material such as styrene-butadene copolymer.

The foregoing description along with the drawings will suggest other modifications and variations. Those configurations within the teaching of this invention are intended to be encompassed by the claims which follow.

What is claimed is:

1. A print element for an impact printer comprising:

a metal alloy insert member having a plurality of beams extending radially outward from a center section, said center section having an opening in the center thereof and a plurality of apertures spaced around the center opening and positioned between the center opening and the beams, character slugs molded to the ends of the beams, said character slugs having an impact surface engageable by hammer means for deflecting the character slug toward a record medium enabling a print surface on the slug to cooperate in a process for marking the record medium, each of said character slugs including a print section and a capture section for coupling to the end of a beam whereby the energy imparted to the character slug by the hammer means is substantially reflected in stresses in the print section of a character slug rather than the capture section, and plastic hub means having a plurality of projections, each of which extends through a respective one of the apertures in the insert member and coacts with the insert member to fixedly couple the hub means to the insert member, said print element having an inertia of from about $6.4 \times 10^{-4}$ in-oz-sec$^2$ to about $8.0 \times 10^{-4}$ in-oz-sec$^2$.

2. The print element of claim 1 having an outside radius of about 1.55 inches.

3. The print element of claim 1 wherein the hub means includes a keyway for fixedly aligning the print element relative to a shaft for rotating the print element to position selected character slugs adjacent a printing path.

4. The print element of claim 1 wherein the beams have a substantially different cross-sectional shape at the ends engageable with the character slugs compared to a generally constant cross-section of the beams along their length.

5. The print element of claim 4 wherein said beams include a section near the ends engageable with the character slugs that has substantially less cross-sectional area than the generally constant cross-sectional portions of the beams.

6. The print element of claim 5 wherein said beam cross-section near the outer end includes a neck formed by generally semi-circularly shaped cutouts on opposite sides of the beam.

7. The print element of claim 1 wherein the length of each beam is from about 0.4 to about 0.6 times the outside radius of the print element as determined by the larger circle inscribed upon rotating the element.

8. The print element of claim 1 wherein said character slugs include a fiberglass reinforced phenolic resin.

9. The print element of claim 8 further including a metallic coating over at least the printing surface of said character slugs.

10. The print element of claim 1 further including damper means coupled to the beams to alter their deflection properties.

11. The print element of claim 10 wherein the damper means includes a fabric member.

12. The print element of claim 11 wherein said fabric member includes an elastomer material.

13. A print element for an impact printer comprising:

a metal alloy insert member having a plurality of beams extending radially outward from a center section, character slugs molded to the ends of the beams, said character slugs having an impact surface engageable by hammer means for deflecting the character slug toward a record medium enabling a print surface on the slug to cooperate in a process or marking the record medium, each of said character slugs including a print section extending beyond the end of a beam and a capture section for coupling to the end of a beam whereby the energy imparted to the character slug by the hammer means is substantially reflected in stresses in the print section of a character slug rather than the capture section, hub means coupled to the center section of the insert member and engageable by a drive shaft, said hub means includes flag means extending radially outward a distance so as to expose a previously printed character when properly positioned relative thereto.

14. The print element of claim 13 having an outside radius of about 1.55 inches and an inertia of about from $6.4 \times 10^{-4}$ in-oz-sec$^2$ to about $8.0 \times 10^{-4}$ in-oz-sec$^2$.

15. The print element of claim 13 wherein the hub means includes a keyway for fixedly aligning the print element relative to a shaft for rotating the print element to position selected character slugs adjacent a printing path.

16. The print element of claim 13 wherein said flag means includes a cross-hair of referencing printed characters including a straight edge for underlining a printed character and a single pointer normal to the straight edge aligned to one side of the underlined printed character.

17. The print element of claim 13 wherein the beams have a substantially different cross-sectional shape at the ends engageable with the character slugs compared to a generally constant cross-section of the beams along their length.

18. The print element of claim 17 wherein said beams include a section near the ends engageable with the character slugs that has substantially less cross-sectional area than the generally constant cross-sectional portions of the beams.

19. The print element of claim 18 wherein said beam cross-section near the outer end includes a neck formed by generally semi-circularly shaped cutouts on opposite sides of the beam.

20. The print element of claim 13 wherein the length of each beam is from about 0.4 to about 0.6 times the outside radius of the print element as determined by the larger circle inscribed upon rotating the element.

21. The print element of claim 13 wherein said insert member includes a 0.006 inch thick cold-reduced, Condition C, 17-7 PH stainless steel.

22. The print element of claim 13 wherein said character slugs include a fiberglass reinforced phenolic resin.

23. The print element of claim 22 further including a metallic coating over at least the printing surface of said character slugs.

24. The print element of claim 13 further including damper means coupled to the beams to alter their deflection properties.

25. The print element of claim 24 wherein the damper means includes a fabric member.

26. The print element of claim 25 wherein said fabric member includes an elastomer material.

27. A print element for an impact printer comprising:

a metal alloy insert member of about 0.006 inch thick cold reduced, condition, C, 17-7 PH stainless steel having a plurality of beams extending radially outward from a center section.

character slugs molded to the ends of the beams, said character slugs having an impact surface engageable by hammer means for deflecting the character slug toward a record medium enabling a print surface on the slug to cooperate in a process for marking the record medium, each of said character slugs including a print section extending beyond the end of a beam and a capture section for coupling to the end of a beam whereby the energy imparted to the character slug by the hammer means is substantially reflected in stresses in the print section of a character slug rather than the capture section, and hub means coupled to the center section of the insert member and engageable by a drive shaft.

28. A print element for an impact printer comprising:

a metal alloy insert member having a plurality of beams extending radially outward from a center section, said center section having an opening in the center thereof and a plurality of apertures spaced around the center opening and positioned between the center opening and the beams, character slugs molded to the ends of the beams, said character slugs having an impact surface engageable by hammer means for deflecting the character slug toward a record medium enabling a print surface on the slug to cooperate in a process for marking the record medium, each of said character slugs including a print section and a capture section for coupling to the end of a beam whereby the energy imparted to the character slug by the hammer means is substantially reflected in stresses in the print section of a character slug rather than the capture section, and plastic hub means having a plurality of projections, each of which extends through a respective one of the apertures in the insert member and coacts with the insert member to fixedly couple the hub means to the insert member, said hub means includes flag means extending radially outward a distance so as to expose a previously printed character when properly positioned relative thereto.

29. The print element of claim 28 wherein said flag means includes a cross-hair for referencing printed characters including a straight edge for underlining a printed character and single pointer normal to the straight edge aligned to one side of the underlined printed character.

* * * * *